US005316655A

United States Patent [19]

Paspek et al.

[11] Patent Number: 5,316,655

[45] Date of Patent: May 31, 1994

[54] PROCESS FOR MAKING LIGHT HYDROCARBONACEOUS LIQUIDS IN A DELAYED COKER

[75] Inventors: Stephen C. Paspek, Broadview Hts.; Christopher P. Eppig, Cleveland Hts.; Jeffrey B. Hauser, Middleburgh Hts.; Carl Polisena, Lyndhurst, all of Ohio

[73] Assignee: The Standard Oil Company, Cleveland, Ohio

[21] Appl. No.: 792,016

[22] Filed: Nov. 13, 1991

Related U.S. Application Data

[63] Continuation-in-part of Ser. No. 482,255, Feb. 20, 1990, Pat. No. 5,068,027, and a continuation-in-part of Ser. No. 482,304, Feb. 20, 1990, abandoned.

[51] Int. Cl.[5] ..... C10G 9/26

[52] U.S. Cl. ..... 208/131; 208/50; 208/132; 208/125

[58] Field of Search ..... 208/131

[56] References Cited

U.S. PATENT DOCUMENTS

| | | | |
|---|---|---|---|
| 2,271,097 | 1/1942 | Ruthruff et al. | 196/49 |
| 2,428,666 | 10/1947 | Hemminger | 196/52 |
| 2,743,214 | 4/1956 | Guernsey | 196/50 |
| 2,847,359 | 8/1958 | Beuther et al. | 196/50 |
| 2,900,327 | 8/1959 | Beuther | 208/106 |
| 3,172,840 | 3/1965 | Paterson | 208/79 |
| 3,369,994 | 2/1968 | Slater et al. | 208/58 |
| 3,580,838 | 5/1971 | Lutz | 208/100 |
| 3,617,480 | 11/1971 | Keel | 208/131 |
| 4,042,487 | 8/1977 | Seguchi et al. | 208/48 R |
| 4,057,490 | 11/1977 | Wynne | 208/127 |
| 4,075,084 | 2/1978 | Skripek | 208/131 |
| 4,080,285 | 3/1978 | McKinney et al. | 208/127 |
| 4,176,052 | 11/1979 | Bruce et al. | 208/131 |
| 4,213,846 | 7/1980 | Sooter et al. | 208/50 |
| 4,298,455 | 11/1981 | Huang | 208/48 AA |
| 4,519,898 | 5/1985 | Allan | 208/131 |
| 4,534,854 | 8/1985 | Weinberg et al. | 208/131 |
| 4,547,284 | 10/1985 | Sze et al. | 208/131 |
| 4,587,007 | 5/1986 | Rudnick | 208/107 |
| 4,604,186 | 8/1986 | Lutz et al. | 208/50 |
| 4,663,019 | 5/1987 | Gartside et al. | 208/50 |
| 4,758,329 | 7/1988 | Newman et al. | 208/131 |
| 4,778,586 | 10/1988 | Bain et al. | 208/132 |
| 4,784,746 | 11/1988 | Farcasiu et al. | 208/106 |
| 4,797,197 | 1/1989 | Mallari | 208/131 |
| 4,828,678 | 5/1989 | Venkat et al. | 208/111 |
| 4,840,725 | 6/1989 | Paspek | 208/130 |
| 4,869,804 | 9/1989 | Perchec et al. | 208/106 |
| 4,877,513 | 10/1989 | Haire et al. | 208/106 |
| 5,068,027 | 11/1991 | Paspek et al. | 208/131 |

*Primary Examiner*—Helane Myers

*Attorney, Agent, or Firm*—David J. Untener; Michael F. Esposito; Brian L. Mehosky

[57] ABSTRACT

A process for making a light hydrocarbonaceous liquid in a delayed coker comprising:

(A) providing a hydrocarbonaceous feed to the coke drum and heating the feed to a temperature of about 800° F. to about 1200° F. to provide an intermediate product; and (B) introducing said intermediate product into the coke drum, operating the coke drum to convert the intermediate product to a final comprising light liquid and coke, and separating the light liquid from the coke;

step (A) being conducted in combination with either step (A) (i) or step (A) (ii);

Step (A) (i) comprising maintaining the feed during step (A) in an enclosed space and subjecting the feed to a pressure that is at least about 500 psig and is sufficient to maintain the specific gravity of the contents of the enclosed space at least about 0.05 to convert said feed to said intermediate product, the intermediate product containing fractions having a lower boiling point than the initial boiling point of the feed and/or a higher boiling point than the final boiling point of the feed, then reducing the pressure on the intermediate product below about 500 psig prior to step (B);

step (A) (ii) comprising contacting the intermediate product from step (A) prior to and/or during step (B) with at least one preheated stripping gas and dissolving at least part of the intermediate product in the stripping gas.

21 Claims, 4 Drawing Sheets

PROCESS FOR MAKING LIGHT HYDROCARBONACEOUS LIQUIDS IN A DELAYED COKER

This application is a continuation-in-part of U.S. application Ser. No. 07/482,255, filed Feb. 20, 1990 now U.S. Pat. No. 5,068,022. This application is also a continuation-in-part of U.S. application Ser. No. 07/482,304, filed Feb. 20, 1990 now abandoned. These prior applications are incorporated herein by reference in their entireties.

TECHNICAL FIELD

This invention relates to a process for making light hydrocarbonaceous liquids in a delayed coker.

BACKGROUND OF THE INVENTION

The term "light hydrocarbonaceous liquid" as used herein refers to any hydrocarbonaceous liquid that boils at a temperature below about 1000° F. at atmospheric pressure.

Delayed cokers are used on low value hydrocarbonaceous feeds to obtain higher-value, lower-boiling cracked products. Coking is a high severity thermal cracking or destructive distillation process. It is typically used on vacuum residuum to generate lighter components. In a delayed coker, the hydrocarbonaceous feed is held at an elevated temperature (e.g., about 825° F. to about 925° F.) to deposit coke in the coke drum while cracked vapors containing light hydrocarbonaceous liquids are taken overhead. In general, coking processes that minimize coke yield and maximize light hydrocarbonaceous liquid yield are advantageous.

U.S. Pat. No. 2,271,097 discloses a process for converting high boiling hydrocarbons into lower boiling hydrocarbons. The process includes the step of heating the bottoms from a fractionator in a viscosity breaker at a temperature of 850°-950° F. and a pressure of 75-500 psig.

U.S. Pat. No. 3,172,840 discloses a process for converting hydrocarbonaceous materials such as petroleum oils to gasoline and middle distillates. The process includes the step of cracking a product stream boiling in the range of 750°-950° F. from a coker bubble tower in a thermal cracking furnace at a temperature of 850°-1000° F. and a pressure of 300-1000 psig.

U.S. Pat. No. 4,213,846 discloses a delayed coking process that employs a hydrotreating step wherein gas oil from the coker fractionator is hydrotreated at a temperature of 315°-400° C. (599°-752° F.) and a hydrogen partial pressure of 350-2000 psig.

U.S. Pat. No. 4,519,898 discloses a delayed coking process wherein the oil feed is preheated to a temperature in the range of about 775° F. to about 920° F. and a stripping gas (e.g., steam, nitrogen, normally gaseous hydrocarbons, natural gas) is introduced into the coking drum to form coke containing 5 to 15 weight percent volatile matter.

U.S. Pat. No. 4,547,284 discloses a delayed coking process wherein the feedstock is continuously heated in a coking heater and introduced into a coke drum, the heater is operated to provide a coke drum temperature of from 415°-455° C. (779°-851° F.), and after filling of the drum to the desired level, feedstock introduction is discontinued and the coke drum contents are heated to a temperature of 450°-500° C. (849°-932° F.) and which heating temperature is at least 10° C. (18° F.) greater than the coking temperature, by passing a non-coking vapor (e.g., coker distillate, naphtha, coker gas) through the contents of the drum to reduce the volatile combustible matter content thereof.

U.S. Pat. No. 4,758,329 discloses a delayed coking process wherein the feedstock is an aromatic mineral oil, and the coke CTE is reduced and the coke particle size is increased by sparging with a gas (e.g., nitrogen) during the coking cycle.

U.S. Pat. No. 4,784,746 discloses a process for upgrading crude oil (whole crude or topped crude) by combining the crude oil with a low boiling component that boils below 330° F. and has an aromatic content of at least 20%, then heating the resulting mixture at 400°-500° C. (752°-932° F.) and a pressure sufficient to maintain the feed stream in the liquid phase. The reference discloses pressures in the range of 100-1000 psig. The process is conducted for an effective period of time to increase the proportion of non-residual components in the crude oil using a transalkylation process.

U.S. Pat. No. 4,840,725 discloses a process for converting high boiling hydrocarbons to lower boiling materials characterized by an increase in aromatic content and a lower pour point which comprises contacting said high boiling hydrocarbons with water at a temperature of from about 600° F. to about 875° F. and a pressure of at least about 2000 psig in the absence of any externally supplied catalysts, and wherein the weight ratio of water to high boiling hydrocarbons is from about 0.5:1 to about 1:1, and the water and high boiling hydrocarbon form a substantially single phase system under the elevated temperature and pressure conditions used.

SUMMARY OF THE INVENTION

This invention relates to a process for making a light hydrocarbonaceous liquid in a delayed coker, said delayed coker including at least one coke drum, the process comprising:

(A) providing a hydrocarbonaceous feed for said coke drum and heating said feed to a temperature in the range of about 800° F. to about 1200° F. to provide an intermediate product; and (B) introducing said intermediate product into said coke drum, operating said coke drum for a sufficient period of time to convert said intermediate product to a final product comprising said light liquid and coke, and separating said light liquid from said coke;

step (A) being conducted in combination with either step (A)(i) or step (A)(ii);

step (A)(1) comprising maintaining said feed during step (A) in an enclosed space in the absence of externally supplied water or hydrogen and subjecting said feed to a pressure that is at least about 500 psig and is sufficient to maintain the specific gravity of the contents of said enclosed space at a level of at least about 0.05 for an effective period of time to convert said feed to said intermediate product, said intermediate product containing fractions having a lower boiling point than the initial boiling point of said feed and/or a higher boiling point than the final boiling point of said feed, then reducing the pressure on said intermediate product to a pressure below about 500 psig prior to step (B);

step (A)(ii) comprising contacting said intermediate product from step (A) prior to and/or during step (B) with at least one stripping material and dissolving at least part of said intermediate product in said stripping material, said stripping material having been preheated to a temperature of at least about 900° F. and in excess of the temperature to which said feed is heated during step (A), said stripping material being in a gaseous state at said preheated temperature and atmospheric pressure.

DESCRIPTION OF THE PREFERRED EMBODIMENTS

Figure 1:
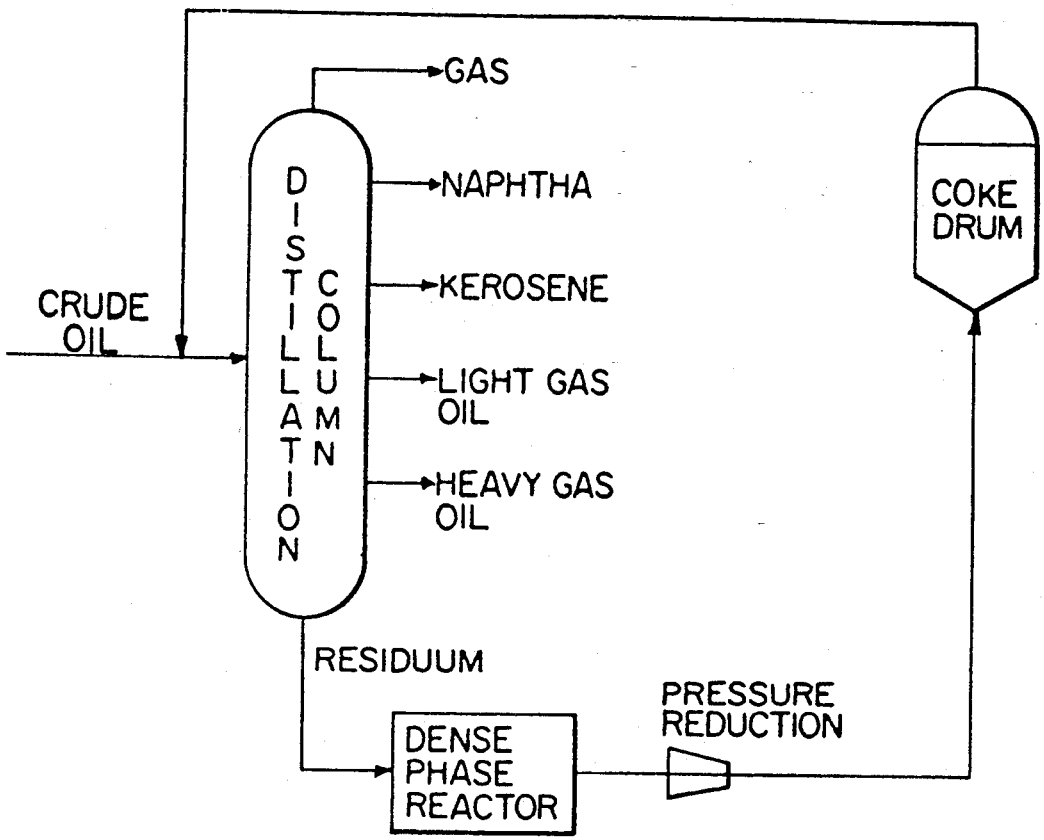
FIG. 1 is a flow sheet illustrating one embodiment of the invention wherein the residuum from a crude oil distillation column is initially heated in a dense phase reactor and then coked in a delayed coker drum.

The inventive process is directed to making light hydrocarbonaceous liquids in a delayed coker. The delayed coker utilizes at least one coke drum and also typically utilizes a fractionation column upstream of the coke drum. In one embodiment the feed to the coke drum is heated in a dense phase reactor and then part (e.g., high boiling materials) or all of the resulting intermediate product is coked in the coke drum. In an optional step, the intermediate product produced in the dense phase reactor is contacted with a superheated stripping material prior to being advanced to the coke drum and/or while in the coke drum. In one embodiment, the feed to the coke drum is heated in a conventional furnace, then contacted with a superheated stripping material prior to being advanced to the coke drum and/or while in the coke drum. In one embodiment, the feed to the coke drum is heated in a dense phase reactor, the resulting intermediate product is then fractionated, and the residium from the fractionated intermediate product is coked in the coke drum. With each embodiment, the pretreated feed enters the coke drum and the coke drum is operated under coking conditions with cracked vapors containing light hydrocarbonaceous liquids being taken overhead and coke being deposited in the coke drum.

The feed to the coke drum that is treated in accordance with the inventive process can be selected from a wide range of hydrocarbonaceous materials. These include, for example, residual oil (e.g., petroleum oil fractions such as heavy gas oil, residuum, etc.), bitumen, crude oil (whole or topped), fluid catalytic cracker decanted oil, slop oils, and other high-boiling or heavy hydrocarbon oils. The hydrocarbonaceous materials can be aliphatic, alicyclic, aromatic or a mixture thereof. They can have initial boiling points of generally at least about 625° F. In one embodiment of the invention the initial boiling point of the hydrocarbonaceous material is at least about 700° F.; in another embodiment it is at least about 800° F.; in another embodiment it is at least about 900° F.; and in another embodiment it is at least about 1000° F. In one embodiment, the hydrocarbonaceous material has an initial boiling point in the range of about 625° F. to about 850° F. and a final boiling point in the range of about 700° F. to about 1000° F. In one embodiment the hydrocarbonaceous material has an initial boiling point in the range of about 700° F. to about 950° F. and a final boiling point in the range of about 900° F. to about 1100° F. In one embodiment the hydrocarbonaceous material has an initial boiling point in the range of 750° F. to about 1000° F. and no final boiling point; that is, at least some of the hydrocarbonaceous material treated in this embodiment of the invention thermally decomposes below its atmospheric pressure boiling point. In one embodiment the hydrocarbonaceous material is other than crude oil, e.g., whole or topped crude oil.

THE DENSE PHASE REACTOR

The operation of the dense phase reactor is carried out in the absence of externally supplied water or hydrogen. In one embodiment, it is carried out in the absence of externally supplied catalysts.

The operating temperature used in the dense phase reactor is in the range of about 800° F. to about 1200° F., preferably about 800° F. to about 1000° F., more preferably about 850° F. to about 950° F., more preferably about 875° F. to about 925° F.

The operating pressure used in the dense phase reactor is at least about 500 psig, preferably at least about 750 psig, more preferably at least about 1000 psig, more preferably at least about 1200 psig, more preferably at least of about 1350 psig, more preferably at least about 1500 psig. The dense phase reactor can be operated at pressures at least about 1800 psig, or at least about 2000 psig. A practical upper limit on pressure is about 10,000 psig, and upper limits of about 6000 psig, more preferably about 4000 psig are useful. The dense phase reactor can be operated at pressures in the range of about 500 to about 10,000 psig, more preferably about 1000 to about 6000 psig, more preferably about 1200 to about 4000 psig, more preferably about 1500 to about 3000 psig.

In one embodiment the dense phase reactor is operated at a temperature of about 850° F. to about 950° F., and a pressure in the range of about 1000 to about 1200 psig.

An important and critical feature of this embodiment of the invention is that the operating temperature and pressure in the dense phase reactor must be sufficient to maintain the specific gravity of the reactor contents (i.e., feed and converted product) under reaction conditions of at least about 0.05, preferably in the range of about 0.05 to about 1.5, more preferably about 0.1 to about 1.2, more preferably about 0.1 to about 1, more preferably about 0.1 to about 0.8, more preferably about 0.1 to about 0.5. All specific gravities that are disclosed herein are referenced to the density of water at 60° F. In a reactor wherein the pressure is maintained at a constant or substantially constant level (e.g., flow-through reactor) there is a tendency for the specific gravity of the reactor contents to decrease as the reaction progresses, and in such a reactor it is preferred that the specific gravity of the reactor contents be maintained in the foregoing ranges at or near the reactor exit. In one embodiment of the invention, the specific gravity is maintained at a sufficient level to maintain all or substantially all (e.g., at least about 85% by weight, more preferably at least about 90% by weight, more preferably at least about 95% by weight) of the reactor contents in liquid phase.

The specific gravity of the reactor contents under reaction conditions can be measured using known techniques. For example, flow from the reactor can be diverted to a tube having a fixed volume; the tube is cooled and weighed and the specific gravity is calculated from this measurement.

The reaction in the dense phase reactor is conducted generally for a period of time which is sufficient to provide the desired conversion of the hydrocarbonaceous feed material to low and/or high boiling materials. The time of the reaction will, of course, vary depending upon the temperature, pressure and the specific hydrocarbonaceous material being treated. For example, at the lower temperatures and pressures, the reaction time will be longer whereas at the higher temperatures and pressures, the time required to obtain the desired conversion is reduced. The three factors of temperature, pressure and time can be varied as determined by one skilled in the art. Depending on these factors, the reaction time may be as short as a few seconds or as long as several hours (e.g., about 5 seconds to about 10 hours), but more generally is from about one minute to about one hour. In one embodiment, the reaction time is from about one to about 10 minutes.

The operation of the dense phase reactor can be conducted either as a batch, semi-batch or continuous process. When a batch process is utilized, the feed material is added to a reaction vessel such as an autoclave. The autoclave is then sealed and heated to the desired operating temperature and pressure, and when the operating temperature and pressure are reached, they are maintained for the allotted period of time to effect the desired degree of reaction. Generally, a period of from about one minute to about one hour, more preferably about one to about 10 minutes, is adequate to provide the desired degree of conversion to high and/or low boiling materials. The reactor then is cooled, for example, to room temperature, the pressure is released and the reactor is emptied. The reactor contents are then advanced to the coker. In one embodiment, desired low boiling fractions can be isolated and recovered using known techniques such as by distillation or by chromatographic techniques prior to coking. A semi-batch process is similar to a batch process except that at least some of the product is removed from the reactor on a continuous or semi-continuous basis as it is generated.

When a continuous process is utilized, the product obtained from the dense phase reactor is advanced to the coke drum. In one embodiment, desired low boiling fractions can be isolated and separated prior to coking. The product produced in the dense phase reactor, or parts thereof (e.g., desired high boiling fractions), can be recycled to the dense phase reactor where the recycled material is, in effect, subjected to a second thermal treatment, and further conversion to low and/or high boiling materials is achieved.

The pressure on the product (or intermediate product) produced in the dense phase reactor is reduced to less than about 500 psig, and advantageously to a pressure less than about 250 psig, prior to advancing said product, or part thereof, to the coke drum. Pressure reduction can be effected using any conventional means, for example, valve means, turbine means, choke means, or a combination thereof. In one embodiment, the pressure is reduced to a level that is sufficient to provide the necessary inlet pressure for advancing feed into the coke drum and removing cracked vapors overhead. In this embodiment, a typical coke drum has a pressure differential of about 20 to about 200 psi between its inlet and outlet, an outlet pressure in the range of about 15 to about 50 psig; thus an inlet pressure in the range of about 35 to about 250 psig.

In one embodiment, the feed to the dense phase reactor is combined with at least one organic solvent. This solvent must be capable of dissolving at least about 10 parts of the feed being treated per million parts of said organic solvent at the temperature wherein at least about 50% by weight of said organic solvent boils at atmospheric pressure. These solvents include aromatic compounds, cycloaliphatic compounds, aliphatic-substituted aromatic compounds, cycloaliphatic-substituted aromatic compounds, aliphatic-substituted cycloaliphatic compounds, and mixtures thereof. These compounds include substantially hydrocarbon compounds as well as purely hydrocarbon compounds. The term "substantially hydrocarbon" is used herein to mean that the compounds contain no non-hydrocarbon substituents or non-carbon atoms that significantly affect the hydrocarbon characteristics or properties of such compounds relevant to their use herein as solvents. The aromatic compounds can be mononuclear (e.g., benzene) or polynuclear (e.g., naphthalene, anthracene, etc.). The aliphatic substituents on the aromatic compounds can be straight chain hydrocarbon groups of 1 to about 3 carbons, cyclic groups of about 3 to about 6 carbons, or mixtures thereof. The aromatic compounds can be monosubstituted or polysubstituted.

The organic solvent preferably can have an initial boiling point in the range of about 0° F. to about 500° F., and a final boiling point in the range of about 200° F. to about 1000° F. at atmospheric pressure. These solvents can have an aromatic content in excess of about 25% by weight, and in many instances they have an aromatic content in excess of about 50% by weight. In one embodiment, this solvent has an initial boiling point in the range of about 50° F. to about 150° F., and a final boiling point in the range of about 200° F. to about 300° F. In another embodiment, this solvent has an initial boiling point in the range of about 180° F. to about 2800° F., and a final boiling point in the range of about 325° F. to about 425° F. In another embodiment, this solvent has an initial boiling point in the range of about 200° F. to about 325° F., and a final boiling point in the range of about 425° F. to about 525° F. In another embodiment, this solvent has an initial boiling point in the range of about 300° F. to about 500° F., and a final boiling point in the range of about 650° F. to about 850° F. In one embodiment, at least about 50% by weight, more preferably at least about 75% by weight, more preferably at least about 90% by weight, of this solvent boils at a temperature below about 750° F. at atmospheric pressure, and all or substantially all of said solvent boils at a temperature below about 1000° F. at atmospheric pressure. A useful solvent has an initial boiling point in the range of about 200OF. to about 325° F., preferably about 260° F. to about 290° F., a 90% by weight boiling point in the range of about 350° F. to about 450° F., preferably about 380° F. to about 420° F. (that is, 90% by weight of the solvent boils at a temperature below about 350° F. to about 450° F. at atmospheric pressure), and a final boiling point in the range of about 425° F. to about 525° F., preferably about 460° F. to about 490° F; this solvent preferably contains in excess of about 50% by weight aromatics, more preferably in excess of about 75% by weight aromatics, more preferably in excess of about 90% by weight aromatics. Another useful solvent has an initial boiling point in the range of about 300OF. to about 500° F., preferably about 360° F. to about 420° F., a final boiling point in the range of about 650° F. to about 850° F., preferably about 720° F. to about 780° F; this solvent preferably has an aromatics content in excess of about 45% by volume, more preferably in the range of about 50% to about 90% by volume, more preferably about 60% to about 80% by volume.

The organic solvent can be an aromatic or aromatic-rich solvent that is readily available from a refinery system such as, for example, one or more reformates (e.g., light reformate, heavy reformate, etc.) that are produced by reformers in a typical refinery system. A typical light reformate has an initial boiling point in the range of about 50° F. to about 150° F., a final boiling point in the range of about 250° F. to about 350° F., and contains benzene and toluene. A typical heavy reformate has an initial boiling point in the range of about 250° F. to about 350° F., a final boiling point in the range of about 450° F. to about 550° F., and contains toluene, ethylbenzene, o-xylene and p-xylene.

The organic solvent can be a middle distillate such as fuel oil (e.g., straight run distillates, diesel oil, etc.), kerosene, and the like. The solvent can be naphtha, gas oil, cycle oil, decanted oil, hexane, benzene, toluene, xylene, naphthalene, or a mixture of two or more thereof. The organic solvent can be a natural gas condensate containing hydrocarbons of about 7 to about 12 carbon atoms and having an aromatic and/or naphthene content of about 40% to about 90% by weight.

The feed material being treated in the dense phase reactor can be mixed with an effective amount of organic solvent to improve the handling (e.g., pumping) characteristics of the feed material, to reduce coke formation in the dense phase reactor, and/or improve selectivity in the product produced in said dense phase reactor to desired low-boiling fractions. Contacting of the feed material and solvent can be effected prior to and/or during treatment in the dense phase reactor. Thus, for example, if a flowthrough dense phase reactor is used, the solvent can be mixed with the feed material prior to entry into the reactor; or part of the solvent can be mixed with the feed prior to entry into the reactor and part can be added to the reactor contents at one or more entry points along the length of the reactor; or all of the solvent can be added at one or more entry points along the length of the reactor. The weight ratio of organic solvent to feed material being treated in the dense phase reactor preferably ranges from about 0.01 to about 10:1. The weight ratio of organic solvent to feed material can range from about 0.05:1 to about 3:1, more preferably about 0.05:1 to about 1:1, more preferably about 0.1:1 to about 0.5:1, more preferably about 0.1:1 to about 0.3:1.

CONVENTIONAL FURNACE

As an alternative to using the above-described dense phase reactor, the feed to the coke drum can be preheated in a conventional furnace, provided it is subsequently contacted with a superheated stripping material as described in greater detail below.

The feed is heated in the furnace to a temperature in the range of about 800° F. to about 1200° F., preferably about 800° F. to about 1000° F., more preferably about 850° F. to about 950° F., more preferably about 875° F. to about 925° F. The outlet pressure for the furnace is typically less than about 200 psig, and generally is in the range of about 70 to about 100 psig.

The design and operation of the furnace is entirely conventional, and thus does not require further description herein.

SUPERHEATED STRIPPING MATERIAL

The stripping material is heated to a temperature that is at least about 900° F. and is in excess of the temperature of the feed to the coke drum produced in either the dense phase reactor or the conventional furnace. The temperature of the stripping material can be at least about 1000° F., or at least about 1100° F., or at least about 1200° F. The temperature can be in the range of about 900° F. to about 2500° F., more preferably about 900° F. to about 2000° F., more preferably about 1100° F. to about 1700° F.

The stripping material can be any of the hydrocarbonaceous materials described above as being useful as organic solvents in the dense phase reactor, provided such hydrocarbonaceous materials are in a gaseous state at their superheated temperature and atmospheric pressure. In one embodiment, the stripping material is a hydrocarbonaceous material having an initial boiling point in the range of about 0° F. to about 500° F. at atmospheric pressure and a final boiling point in the range of about 200° F. to about 1000° F. at atmospheric pressure. The stripping material can be selected from the group consisting of steam, methane, nitrogen, carbon dioxide, crude oil distillate, naphtha, coker distillate, coker gas and natural gas.

The weight ratio of the coker feed to stripping material is preferably in the range of about 100:1 to about 3:1, more preferably about 20:1 to about 5:1.

The superheated stripping material can be mixed with the coke drum feed prior to entry into the coke drum. Alternatively, the stripping material can be mixed with the coke drum feed in the coke drum. The stripping material can enter the coke drum at any point, with entry in the bottom or lower section being preferred.

In one embodiment, the stripping material is steam, the temperature of said steam being in the range of about 900° F. to about 1700° F., preferably about 1000° F. to about 1500° F., more preferably about 1100° F. to about 1300° F., and the weight ratio of coke drum feed to said steam is about 20:1 to about 5:1, more preferably about 10:1.

COKE DRUM

The coke drum is entirely conventional in design and operation. The coke drum feed enters the coke drum, and cracked vapors containing light hydrocarbonaceous liquids are continuously removed overhead until the coke drum fills to the desired level with coke. The operating temperature of the coke drum is typically in the range of about 650° F. to about 1200° F., more preferably about 700° F. to about 1100° F. The inlet pressure for the coke drum is generally in the range of about 35 to about 250 psig, and the outlet pressure is typically in the range of about 15 to about 50 psig. In one embodiment the coke drum is operated at an inlet temperature of about 850° F. to about 950° F., preferably about 900° F. to about 930° F., and a drum overhead temperature in the range of about 800° F. to about 850° F., preferably about 815° F. to about 830° F. Coke drum cycles are typically about 10 to about 60 hours, and often about 10 to about 40 hours. Once the coke drum has filled to the desired level with coke, the coke drum is decoked by mechanical or hydraulic means such as by use of a high impact water jet. The coke is then broken into lumps and, if desired, it can be calcined.

An advantage of the invention is that the yield of light hydrocarbonaceous liquids is maximized and the yield of coke is minimized. Thus the number of times the operation of the coke drum must be discontinued to permit removal of coke is correspondingly reduced.

In order to further describe the inventive process, reference is made to FIGS. 1-4 wherein various illustrated embodiments of the inventive process are disclosed. The feed materials, solvents, stripping materials, and operating parameters and procedures discussed above are applicable to these illustrated embodiments.

FIG. 1 is a flow sheet illustrating a delayed coker used in combination with a dense phase reactor. The process uses a distillation column, dense phase reactor, pressure reduction apparatus and coke drum. Crude oil is advanced to the distillation column wherein it is fractionated into a gas, naphtha, kerosene, light gas oil, heavy gas oil and a residuum using conventional techniques . The residuum is advanced to the dense phase reactor wherein it is converted into an intermediate product containing fractions having a lower boiling point than the initial boiling point of the residuum and/or a higher boiling point than the final boiling point of the residuum. The intermediate product is advanced through the pressure reduction apparatus wherein the pressure is reduced from the operating pressure in the dense phase reactor to a pressure less than about 500 psig. The intermediate product flows into the coke drum wherein it is coked, and overhead vapors containing light hydrocarbonaceous liquids are recycled to the distillation column. The light hydrocarbonaceous liquids are separated from the coke drum overhead vapors in the distillation column. The process is operated until coke builds to a desired level in the coke drum. Once the level of coke has reached the desired level in the coke drum, the coke is coke is removed from the coke drum using conventional techniques. Alternatively, a second coke drum can be used in parallel with the coke drum in FIG. 1, and the process can be operated on a continuous basis wherein one coke drum is in use while the other one is being decoked.

Figure 2:
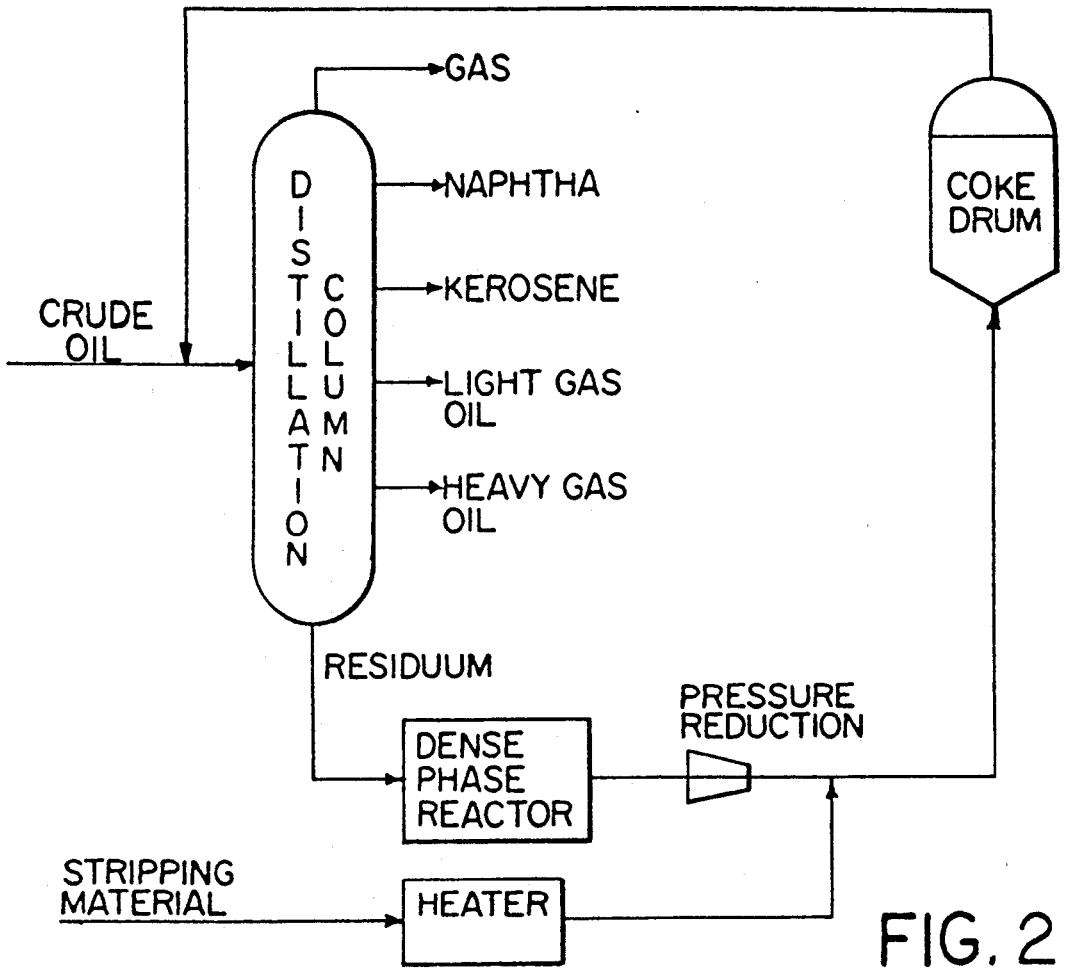
FIG. 2 is a flow sheet illustrating one embodiment of the invention wherein the residuum from a crude oil distillation column is initially heated in a dense phase reactor, contacted with a preheated stripping material, and then coked in a delayed coker drum.

The embodiment illustrated in FIG. 2 is similar to the embodiment illustrated in FIG. 1 with the exception that a superheated stripping material is mixed with the product produced in the dense phase reactor. In FIG. 2, the stripping material is heated in the heater (which can be a conventional furnace or heat exchanger) and then is mixed with the dense phase reactor product downstream of the pressure reduction apparatus but prior to entry into the coke drum. Alternatively, the stripping material can be mixed with the dense phase reactor product in the coke drum. Entry of the stripping material into the coke drum can be effected at any location, but is preferably at or near the bottom of the coke drum.

Figure 3:
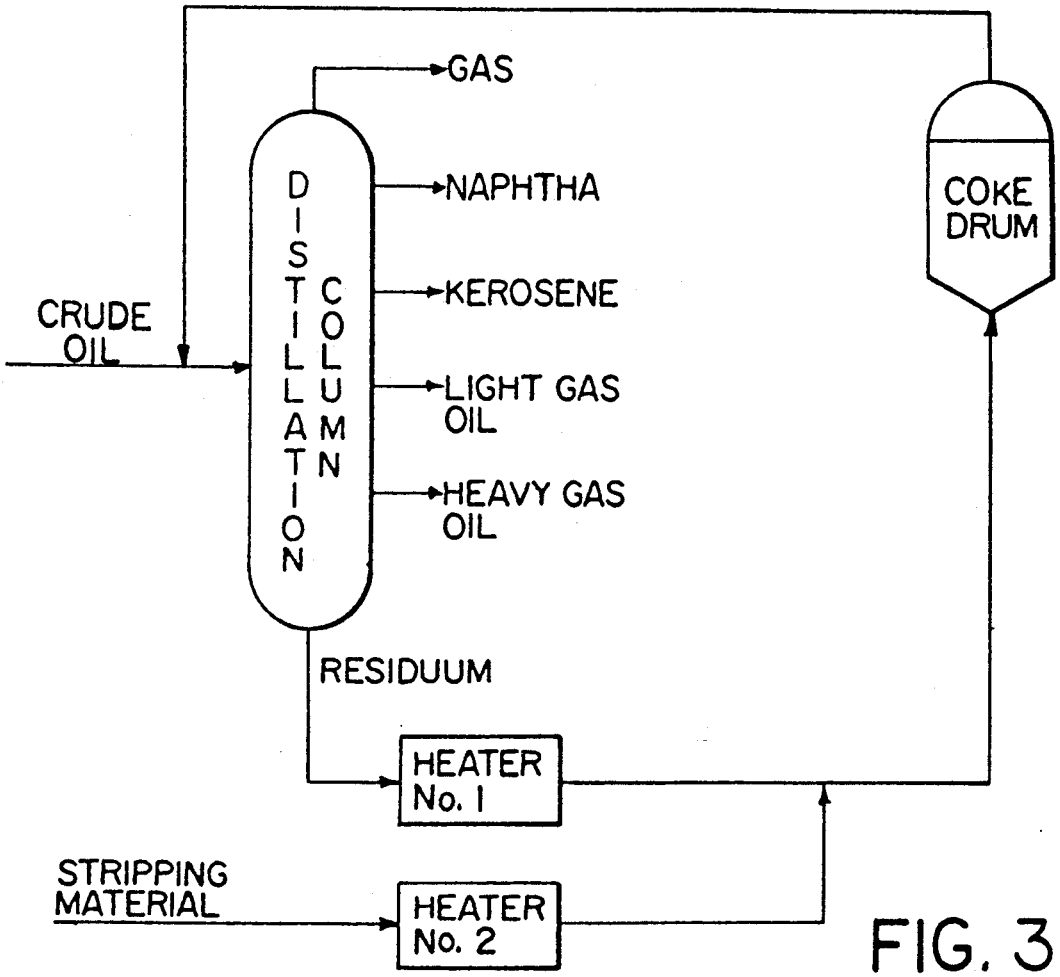
FIG. 3 is a flow sheet illustrating one embodiment of the invention wherein the residuum from a crude oil distillation column is heated, contacted with a preheated stripping material, and then coked in a delayed coker drum.

The embodiment illustrated in FIG. 3 is similar to the embodiment illustrated in FIG. 2, with the exception that the dense phase reactor is replaced by a conventional furnace. In FIG. 3, the conventional furnace is heater No. 1. The furnace or heat exchanger for superheating the stripping material is heater No. 2. Both heaters Nos. 1 and 2 are entirely conventional.

Figure 4:
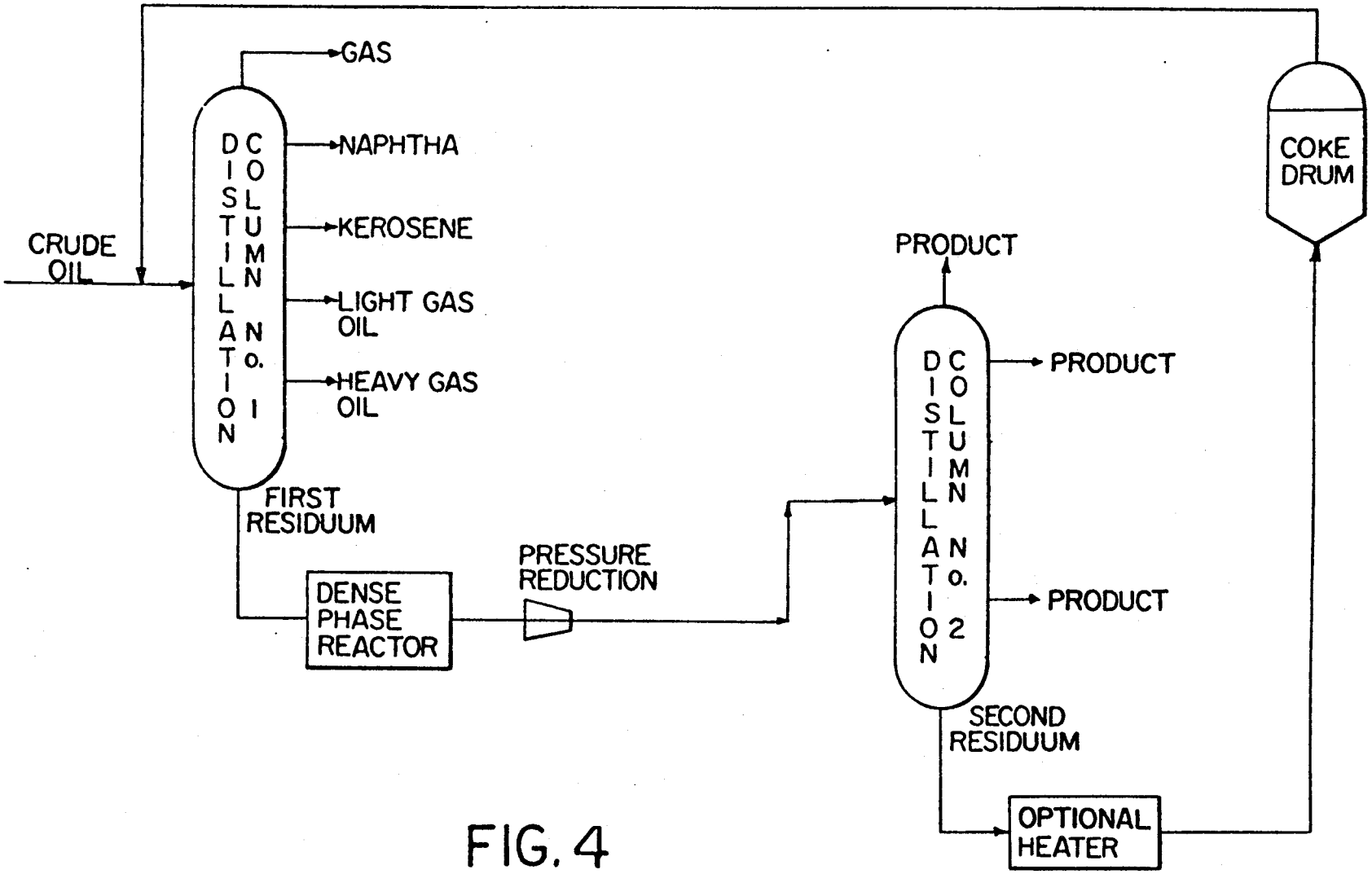
FIG. 4 is a flow sheet illustrating one embodiment of the invention wherein the residuum from a crude oil distillation column is initially heated in a dense phase reactor, fractioned in a second distillation column and then the residuum from the second distillation column is coked in a delayed coker drum.

The embodiment illustrated in FIG. 4 is similar to the embodiment illustrated in FIG. 1 with the exception that the intermediate product produced in the dense phase reactor is fractionated in distillation column No. 2, and the residuum from distillation column No. 2 is then coked in the coke drum. An optional heater is provided for heating the second residuum from distillation column No. 2 prior to advancing said second residuum to the coke drum. The second residuum can be heated to a temperature in the range of about 800° F. to about 1200° F., preferably about 875° F. to about 925° F. in the optional heater prior to being advanced to the coke drum. The products other than the residuum produced in distillation column No. 2 are available for use as conventional distillate products or can be recycled to distillation column No. 1.

The embodiment illustrated in FIG. 4 can be modified by providing for the mixing of a superheated stripping material with the coke drum feed in a manner similar to the embodiment illustrated in FIG. 3.

The following Examples 1-5 are illustrative of the process of the present invention. Unless otherwise indicated, in the following examples as well as throughout the entire specification and in the appended claims, all parts and percentages are by weight, and all temperatures are in degrees Fahrenheit.

With each of the following examples the coke drum that is used is an isothermal batch coke drum which is a 1000 cc stainless steel cylinder that is heated in a fluidized sand bath. It is operated at a temperature of 860° F. and a pressure of 35 psig. The feed material that is treated is bitumen having the following properties:

| Boiling point distribution: | |
|---|---|
| Temperature °F. | Wt. % |
| Initial boiling point-380 | 1 |
| 380-650 | 14 |
| 650-850 | 21 |
| 850-975 | 12 |
| 975+ | 52 |

API Gravity = 9.5
Specific Gravity = 1.0035

The dense phase reactor is a ¼-inch O.D. stainless steel coil that has a length of 20 feet and is heated in a fluidized sand bath. It is operated at a pressure of 1100 psig and at varying temperatures as indicated below. The stripping material is steam.

In Example 1 the dense phase reactor is used in combination with the coke drum. The operating temperature for the dense phase reactor is 896° F.

In Examples 2 and 3 the dense phase reactor is used in combination with a fractionation column and the coke drum. The temperature in the dense phase reactor is 914° F. In Example 2 the product produced in the dense phase reactor is fractionated and the cut boiling at temperatures above 800° F. is coked in the coke drum. In Example 3 the product produced in the dense phase reactor is fractionated and the cut boiling at temperatures above 900° F. is coked in the coke drum.

In Examples 4 and 5 the feed to the coke drum is mixed with steam, the weight ratio of feed to steam being 100:9. The temperature of the coke drum containing the feed and steam is increased from 860° F. to 880° F. and the pressure is increased from 35 psig to 40 psig to simulate the addition of steam that has been superheated to 1600° F. The dense phase reactor is not used in Example 4, but it is used in Example 5, the operating temperature of the dense phase reactor in Example 5 being 914° F. In Example 5, the feed is initially treated in the dense phase reactor and then in the coke drum An analysis of the products produced in the coke drum for each of Examples 1–5 is provided in the following Table I. With each example the yield of coke is significantly low and the yield of liquids boiling below 1000° F. is significantly high.

TABLE I

| Example No. | 1 | 2 | 3 | 4 | 5 |
|---|---|---|---|---|---|
| Gas ($C_1$–$C_4$), wt. % | 10.5 | 9.2 | 7.7 | 2.5 | 5.1 |
| Liquid, wt. | 67.1 | 71.5 | 73.6 | 79.7 | 76.1 |
| Initial Boiling Point-380° F. | 19.5 | — | 14.5 | 13.3 | 18.8 |
| 380–550° F. | 18.1 | 71.5 | 16.6 | 17 | 18.9 |
| 550–1000° F. | 29.5 | — | 44.5 | 49.4 | 38.4 |
| 1000+° F. | 0 | 0 | 0 | 0 | 0 |
| Coke, wt. % | 22.5 | 19.3 | 17 | 17.8 | 18.8 |

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A process for making a light hydrocarbonaceous liquid in a delayed coker, said delayed coker including at least one coke drum, the process comprising:

(A) providing a hydrocarbonaceous feed for said coke drum and heating said feed to a temperature in the range of about 800° F. to about 1200° F. to provide an intermediate product; and (B) introducing said intermediate product into said coke drum, operating said coke drum for a sufficient period of time to convert said intermediate product to a final product comprising said light liquid and coke, and separating said light liquid from said coke;

step (A) being conducted in combination with either step (A)(i) or step (A)(ii);

step (A)(i) comprising maintaining said feed during step (A) in an enclosed space in the absence of externally supplied water or hydrogen and subjecting said feed to a pressure that is at least about 500 psig and is sufficient to maintain the specific gravity of the contents of said enclosed space at a level of at least about 0.05 for an effective period of time to convert said feed to said intermediate product, said intermediate product containing fractions having a lower boiling point than the initial boiling point of said feed and/or a higher boiling point than the final boiling point of said feed, then reducing the pressure on said intermediate product to a pressure below about 500 psig prior to step (B);

step (A)(ii) comprising contacting said intermediate product from step (A) prior to and/or during step (B) with at least one stripping material and dissolving at least part of said intermediate product in said stripping material, said stripping material having been preheated to a temperature of at least about 900° F. and in excess of the temperature to which said feed is heated during step (A), said stripping material being in a gaseous state at said preheated temperature and atmospheric pressure.

2. The process of claim I wherein step (A)(i) is used, said process further comprising the steps of contacting said intermediate product subsequent to step (A)(i) but prior to and/or during step (B) with at least one stripping material and dissolving at least part of said intermediate product in said stripping material, said stripping material having been preheated to a temperature of at least about 900° F. and in excess of the temperature to which said feed is heated during step (A), said stripping material being in a gaseous state at said preheated temperature and atmospheric pressure.

3. The process of claim 1 wherein step (A)(i) is used and said intermediate product from step (A)(i) is a first intermediate product, said process further comprising the step of fractionating said first intermediate product to provide a second intermediate product containing a residuum, said residuum being said intermediate product in step (B).

4. The process of claim 1 wherein either step (A)(i) or step (A)(ii) is used, said process further comprising the additional step prior to step (A) of fractionating a hydrocarbonaceous material to provide a fractionation product containing either residuum, heavy gas oil or mixture thereof, said fractionation product being said feed in step (A).

5. The process of claim 1 wherein step (A)(i) is used and said intermediate product from step (A)(i) is a first intermediate product, said process further comprising the additional step prior to step (B) of fractionating said first intermediate product to provide a second intermediate product containing a residuum, then contacting said second intermediate product prior to and/or during step (B) with at least one stripping material and dissolving at least part of said second intermediate product in said stripping material, said stripping material having been preheated to a temperature of at least about 900° F. and in excess of the temperature of said second intermediate product, said stripping material being in a gaseous state at said preheated temperature and atmospheric pressure.

6. The process of claim 1 wherein said feed in step (A) is a heavy gas oil, residuum, bitumen, or mixture of two or more thereof.

7. The process of claim 1 wherein said feed in step (A) is a hydrocarbonaceous material having an initial boiling point at atmospheric pressure of at least about 650° F.

8. The process of claim 1 wherein said pressure during step (A)(i) is at least about 1000 psig.

9. The process of claim 1 wherein during step (A)(i) said feed is contacted with at least one organic solvent, said organic solvent being capable of dissolving at least about 10 parts of said feed per million parts of said organic solvent at the temperature wherein at least about 50% by weight of said organic solvent boils at atmospheric pressure.

10. The process of claim 8 wherein said organic solvent is selected from the group consisting of naphtha, gas oil, kerosene, fuel oil, cycle oil, decanted oil, light reformate, heavy reformate, hexane, benzene, toluene, xylene, naphthalene, or a mixture of two or more thereof.

11. The process of claim 8 wherein said organic solvent has an initial boiling point in the range of about 0° F. to about 500° F. at atmospheric pressure, and a final boiling point in the range of about 200° F. to about 1000° F. at atmospheric pressure.

12. The process of claim 8 wherein the weight ratio of said organic solvent to said feed is in the range of about 0.01:1 to about 10:1.

13. The process of claim 1 wherein said stripping material has been preheated to a temperature in excess of about 1000° F. prior to contacting said intermediate product.

14. The process of claim 1 wherein said stripping material is a hydrocarbonaceous material having an initial boiling point in the range of about 0° F. to about 500° F. at atmospheric pressure and a final boiling point in the range of about 200° F. to about 1000° F.

15. The process of claim 1 wherein said stripping material is selected from the group consisting of steam, methane, nitrogen, carbon dioxide, crude oil distillate, naphtha, coker distillate, coker gas, natural gas and mixtures of two or more thereof.

16. The process of claim 1 wherein the weight ratio of said intermediate product to said stripping material is in the range of about 100:1 to about 3:1.

17. The process of claim 1 wherein said step of reducing the pressure on said intermediate product during step (A)(i) is effected using valve means, turbine means, choke means or a combination thereof.

18. A process for making a light hydrocarbonaceous liquid in a delayed coker, said delayed coker including at least one coke drum, the process comprising:

providing a hydrocarbonaceous feed for said coke drum and heating said feed in an enclosed space to a temperature in the range of about 800° F. to about 1200° F. and a pressure that is at least about 500 psig and is sufficient to maintain the specific gravity of the contents of said enclosed space at a level of at least about 0.05 for an effective period of time to convert said feed to an intermediate product containing fractions having a lower boiling point than the initial boiling point of said feed and/or a higher boiling point than the final boiling point of said feed;

reducing the pressure on said intermediate product to a pressure below about 500 psig; and introducing said intermediate product into said coke drum, operating said coke drum for a sufficient period of time to convert said intermediate product to a final product comprising said light liquid and coke, and separating said light liquid from said coke.

19. A process for making a light hydrocarbonaceous liquid in a delayed coker, said delayed coker including at least one coke drum, the process comprising:

providing a hydrocarbonaceous feed for said coke drum and heating said feed to a temperature in the range of about 800° F. to about 1200° F. to provide an intermediate product;

contacting said intermediate product with at least one stripping material and dissolving at least part of said intermediate product in said stripping material, said stripping material having been preheated to a temperature of at least about 900° F. and in excess of the temperature of said intermediate product, said stripping material being in a gaseous state at said preheated temperature and atmospheric pressure;

introducing said intermediate product into said coke drum, operating said coke drum for a sufficient period of time to convert said intermediate product to a final product comprising said light liquid and coke, and separating said light liquid from said coke;

said contacting of said intermediate product with said stripping material being effected in said coke drum and/or prior to the entry of said intermediate product into said coke drum.

20. A process for making a light hydrocarbonaceous liquid in a delayed coker, said delayed coker including at least one coke drum, the process comprising:

providing a hydrocarbonaceous feed for said coke drum and heating said feed in an enclosed space in the absence of externally supplied water or hydrogen to a temperature in the range of about 800° F. to about 1200° F. and a pressure that is at least about 500 psig and is sufficient to maintain the specific gravity of the contents of said enclosed space at a level of at least about 0.05 for an effective period of time to convert said feed to an intermediate product containing fractions having a lower boiling point than the initial boiling point of said feed and/or a higher boiling point than the final boiling point of said feed;

reducing the pressure on said intermediate product to a pressure below about 500 psig;

contacting said intermediate product with at least one stripping material which has been preheated to a temperature of at least about 900° F. and in excess of the temperature of said intermediate product, said stripping material being in a gaseous state at said preheated temperature and atmospheric pressure; and introducing said intermediate product into said coke drum, operating said coke drum for a sufficient period of time to convert said intermediate product to a final product comprising said light liquid and coke, and separating said light liquid from said coke;

said contacting of said intermediate product with said stripping material being effected in said coke drum and/or prior to the entry of said intermediate product into said coke drum.

21. A process for making a light hydrocarbonaceous liquid in a delayed coker, said delayed coker including at least one coke drum, the process comprising:

providing a hydrocarbonaceous feed for said coke drum and heating said feed in an enclosed space in the absence of externally supplied water or hydrogen to a temperature in the range of about 800° F. to about 1200° F. and a pressure that is at least about 500 psig and is sufficient to maintain the specific gravity of the contents of said enclosed space at a level of at least about 0.05 for an effective period of time to convert said feed to a first intermediate product containing fractions having a lower boiling point than the initial boiling point of said feed and/or a higher boiling point than the final boiling point of said feed;

reducing the pressure on said first intermediate product to a pressure below about 500 psig;

fractionating said first intermediate product to provide a second intermediate product comprising a residuum; and introducing said second intermediate product into said coke drum, operating said coke drum for a sufficient period of time to convert said second intermediate product to a final product comprising said light liquid and coke, and separating said light liquid from said coke.

* * * * *